US005613432A

United States Patent [19]

Hoshino

[11] Patent Number: 5,613,432

[45] Date of Patent: Mar. 25, 1997

[54] ARCH TYPE STRAPPING MACHINE

[75] Inventor: Tetsuya Hoshino, Yokohama, Japan

[73] Assignee: Nichiro Kogyo Co., Ltd., Yokohama, Japan

[21] Appl. No.: 524,838

[22] Filed: Sep. 7, 1995

[30] Foreign Application Priority Data

Feb. 3, 1995 [JP] Japan ..... 7-037812
Apr. 7, 1995 [JP] Japan ..... 7-107152

[51] Int. Cl.[6] ..... B65B 13/06

[52] U.S. Cl. ..... 100/26; 53/589; 100/33 PB

[58] Field of Search ..... 100/25, 26, 33 PB; 53/589

[56] References Cited

U.S. PATENT DOCUMENTS

| | | | |
|---|---|---|---|
| 3,179,037 | 4/1965 | Cranston, Jr. et al. | 100/26 |
| 3,196,779 | 7/1965 | Embree | 100/26 |
| 3,572,237 | 3/1971 | Kurihara | 100/26 |
| 4,120,239 | 10/1978 | Pasic et al. | 100/33 PB |
| 4,244,773 | 1/1981 | Siebeck et al. | 100/26 |
| 4,711,071 | 12/1987 | Kägi | 100/26 |
| 4,781,110 | 11/1988 | Sakaki et al. | 100/26 |
| 5,414,980 | 5/1995 | Shibazaki et al. | 100/26 |

*Primary Examiner*—Stephen F. Gerrity
*Attorney, Agent, or Firm*—Oblon, Spivak, McClelland, Maier & Neustadt, P.C.

[57] ABSTRACT

An arch type band guide includes corner elements and straight elements each having the same shape and the same size, wherein the elements are connected in a manner capable of swinging in an arch unit, whereby various sizes of band guide can be easily fabricated depending on the size of articles to be packed.

6 Claims, 15 Drawing Sheets

ARCH TYPE STRAPPING MACHINE

BACKGROUND OF THE INVENTION

1. Field of the Invention

The present invention relates to an improvement in an arch type strapping machine. In particular, it relates to a band guide for a strapping machine in which the band guide is constituted by a few kinds of structural elements each having the same shape and the same size to obtain various sizes of band guide, and in which the structural elements are combined depending on the size of articles to be packed, whereby the band guide can be produced in a large scale production economically.

2. Discussion of the Background

Conventional arch type strapping machines have been of a one-piece body type. FIGS. 14 and 15 show a conventional band guide 151 for winding a band B around an article to be packed wherein the band B is supplied through a band feeding rollers driven by a driving unit. The band guide is constituted by an elongated one-piece body having substantially a ]-shaped groove.

The band guide was formed by, for instance, extruding synthetic resin or metal to be an elongated one-piece body having a ]-shaped groove in cross section. Then, the one-piece body was cut at an appropriate length, and a cut piece was subjected to bending operations whereby a band guide having a predetermined size can be formed.

In conventional techniques, the strapping machines of various sizes were manufactured depending on the sizes of articles to be packed. Accordingly, it was necessary to chose the size, i.e. the entire length and the shape of band guides so as to meet the sizes of the strapping machines. The production of various sizes of band guides depending on strapping machines having various sizes made working processes complicated. Further, since the band guides were not interchangeable between the strapping machines of various sizes, large-scale production was impossible and manufacturing costs were increased.

Further, the conventional band guides had a disadvantage that the removal of a band from the groove of a band guide at the time of returning the band was not smooth. Namely, since the conventional band guide was prepared by bending an elongated one-piece body, there was difficulty in removing the band from the groove at the time of returning the band. Specifically, the band guide supported by an arch unit 50 by means of springs in a movable manner is moved as a whole at the time of removing the band as shown in FIG. 15. Since, the band guide is formed of an elongated one-piece body, the entirety of the band guide tends to move as a whole at the time of the removal of the band B. Accordingly, the band B is not successively removed from the band guide, and a portion of the band B received in an upper band guide portion falls at the same time of the removal of the band at a lower band guide portion. This may result in twisting of the band when the band is wound around the article. Further, the movement of the band guide having a large weight can not be smooth because it has a large force of inertia. Therefore is therefore a large amount of friction generated between the band B and an inner side surface of the groove when the band is removed. Accordingly, a large force is required to return the band B. As a result, an excessive force acts on the returning rollers, and working efficiency decreases.

SUMMARY OF THE INVENTION

It is an object of the present invention to eliminate the disadvantages of the conventional one-piece type band guide, such as an increase in manufacturing costs and an unsmooth motion of the band at the time of removal, and to provide a band guide for an arch type strapping machine suitable for mass-production and of a low cost.

It is another object of the present invention to provide a band guide which avoid the necessity of generating a large torque in a driving mechanism at the time of tightening the band and allowing a smooth tightening operation at a high speed.

It is an object of the present invention to provide a band guide which simplifies assembling operations of the same regardless of the size of the article to be packed.

The above-mentioned and other objects of the present invention have been attained by providing a strapping machine of a type of winding a band around an article and pulling back the band to tighten the article, characterized in that the strapping machine has a band guide having a ]-like shape in cross section to guide the band, and the band guide is formed by connecting a plurality of straight elements and a plurality of corner elements.

The straight elements and the corner elements are connected by means of pivots so as to be swingable. Further, they can be formed by injection-molding synthetic resin so that mass-production can be achieved.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
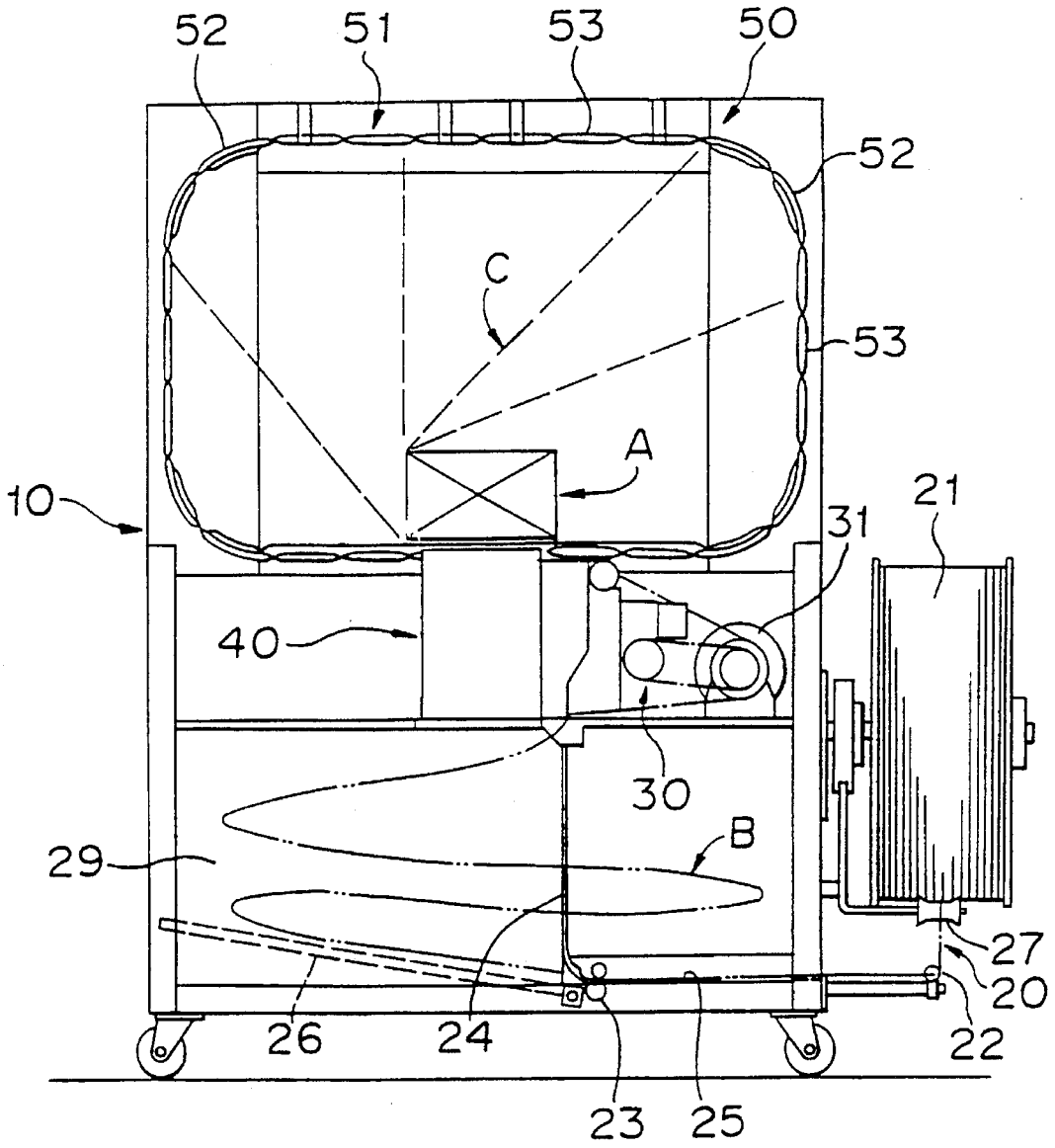
FIG. 1 is a schematic front view of an embodiment of the strapping machine of the present invention.
Figure 2:
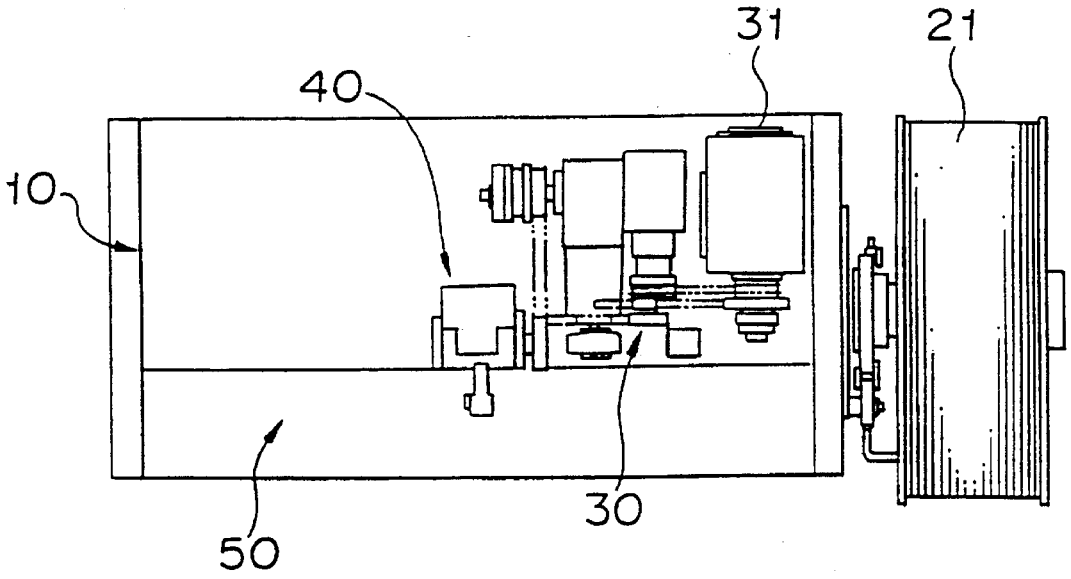
FIG. 2 is a plan view of the strapping machine shown in FIG. 1.

In FIG. 1, the main body 10 of the strapping machine according to the present invention generally comprises a band feeding unit 20, a roller unit 30, a seal unit 40 and an arch unit 50.

The band feeding unit 20 has a band reel 21 on which a band B is wound, a guide roller 22, a guide 25, an auxiliary feeding unit comprising a pair of rollers 23 and a guide 24. The band B is supplied to a roller unit 30 through the above-mentioned elements.

Further, the band feeding unit 20 has a chamber 29 in a lower portion of the main body 10. The chamber 29 provides a smooth supply of a band by temporarily accumulating the band which is to be fed to a binding portion at a high speed for packaging, and receives a retracted portion of the band when the band is subjected to a tightening operation.

A band accumulation sensor 26 is disposed in the chamber 29 so that a predetermined amount of the band is always stored in the chamber 29. The amount of accumulation of the band is detected depending on a position of the band accumulation sensor 26. Thus, the supply of the band from the band reel 21 to the chamber 29 can be controlled.

Figure 3:
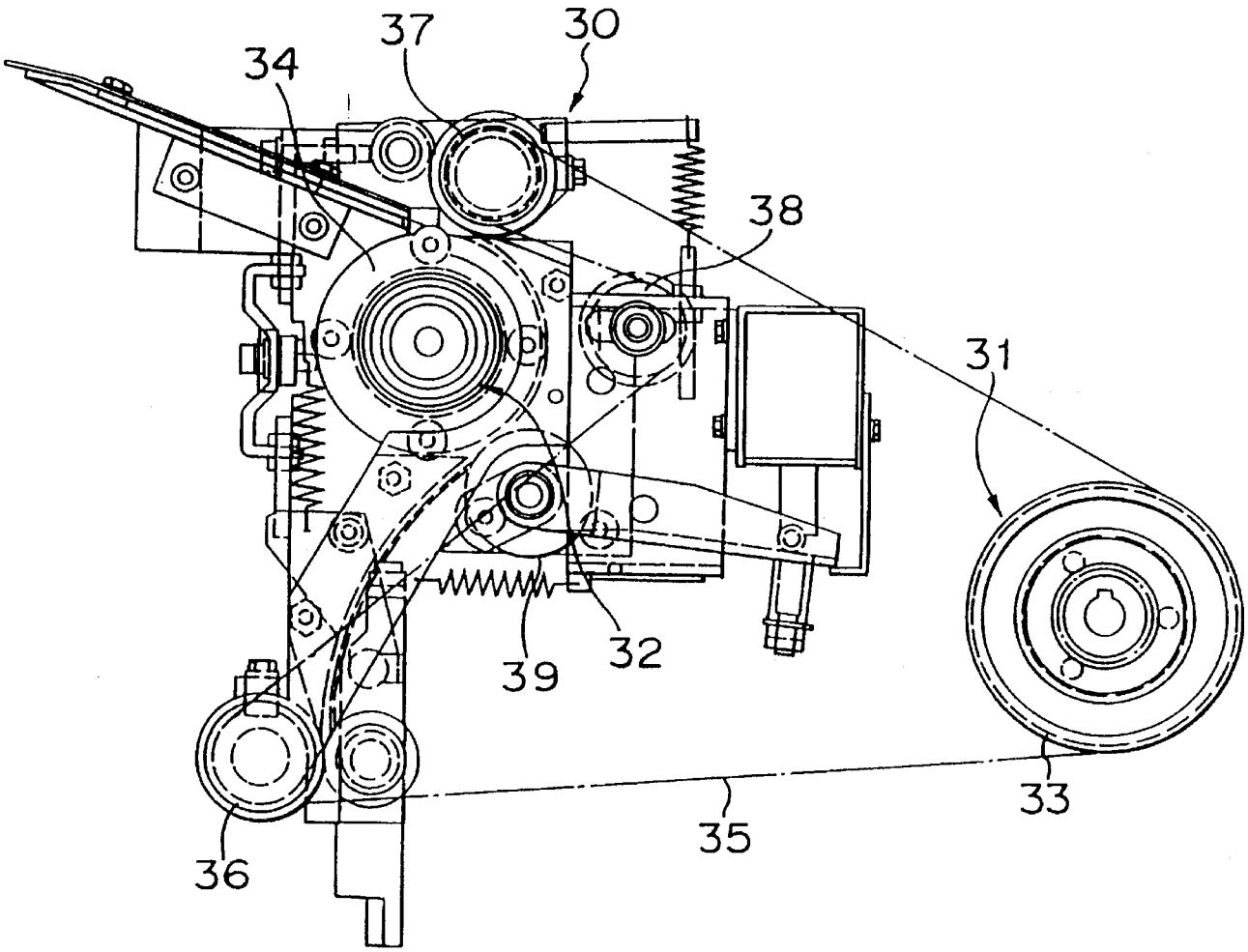
FIG. 3 is an enlarged front view of a driving unit for the strapping machine.
Figure 4:
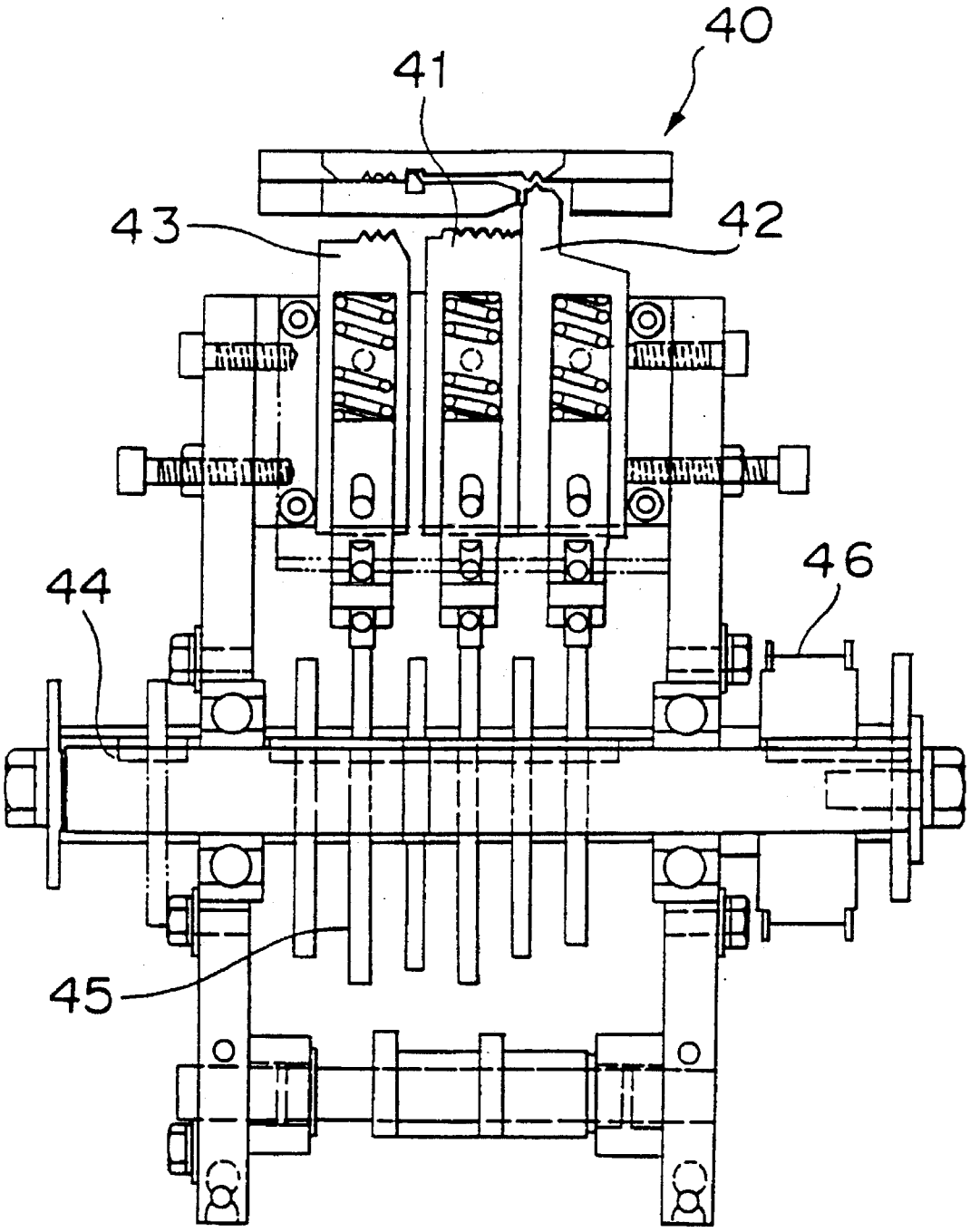
FIG. 4 is an enlarged front view of a seal unit of the strapping machine shown in FIG. 1.
Figure 5:
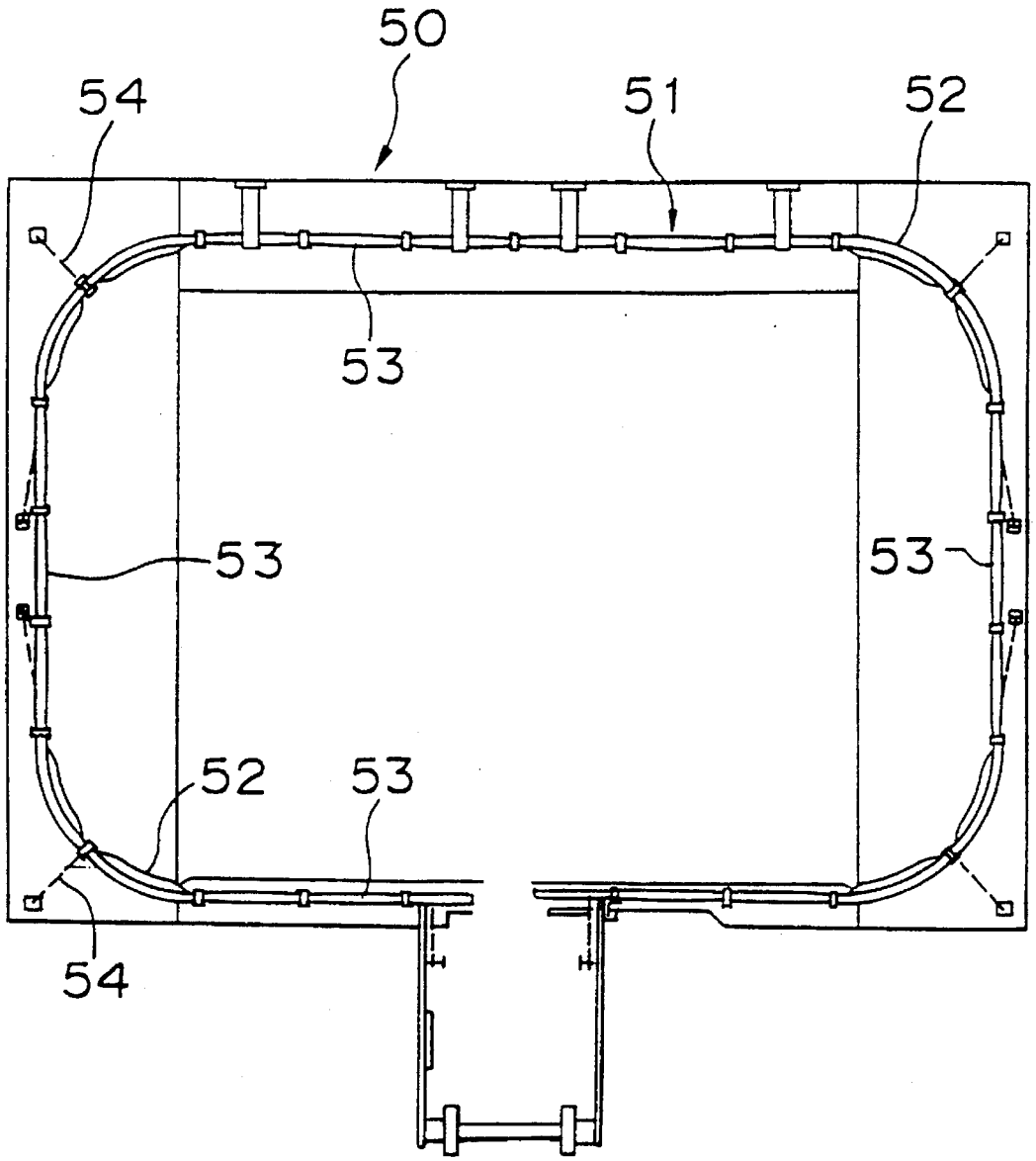
FIG. 5 is a front view of an arch unit having a band guide which is a feature of the present invention.

In FIG. 3, the roller unit 30 has a groove of rollers such as a pair of feeding rollers 36, a high-speed return roller 37 and a tension roller 38 which are driven via a belt 35 extended to a large diameter pulley 33 fixed to the shaft of a motor 31 through an electromagnetic clutch, a main roller 34 which is connected to the output shaft of a speed reduction gear through a one-way clutch 32, and a secondary tightening rocker roller 39 facing the main roller 34 to strongly tighten the band.

The seal unit 40 is to fix the top end of the band B which has been wound around an article A to be packed; to bind the band tightened by means of heat bonding, and to cut the band. The seal unit comprise a sealing portion composed of a compression head 41, grippers 42, 43 and an operating cam 45, a cam shaft 44, a cam shaft driving pulley 46 and so on which operate the sealing unit.

Figure 6:
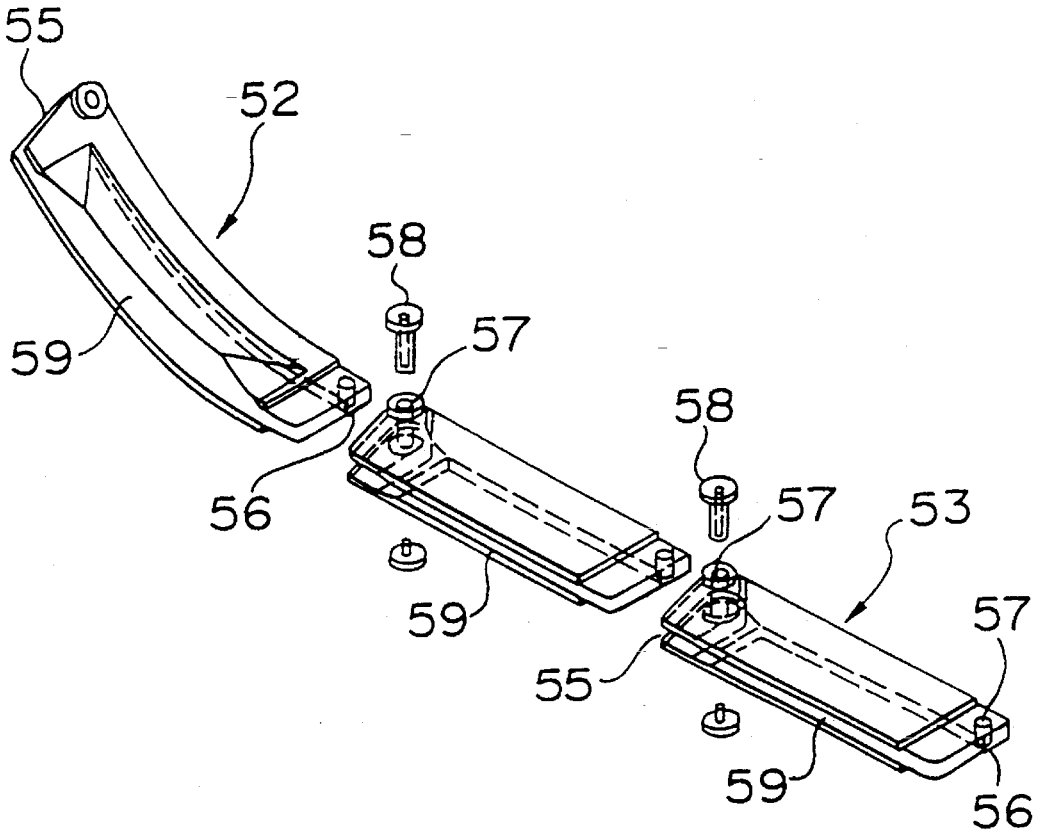
FIG. 6 is an enlarged perspective view showing structural elements for the band guide shown in FIG. 5.
Figure 7:
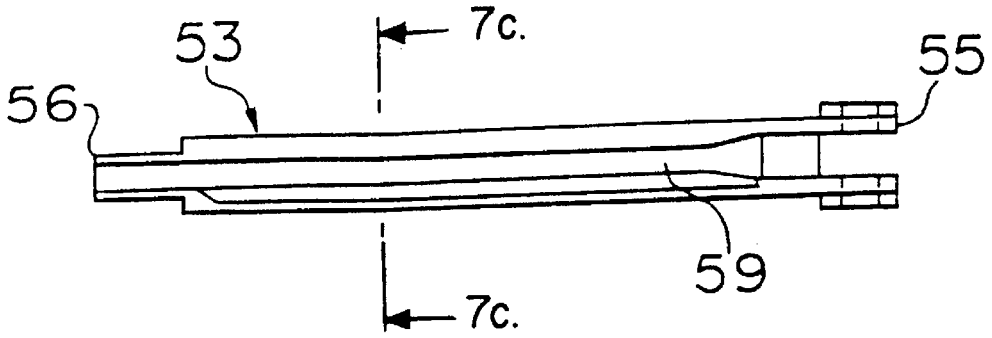
FIGS. 7*a*, 7*b* and 7*c* are respectively a side view, a front view and a cross-sectional view of a straight element for the band guide.
Figure 7:
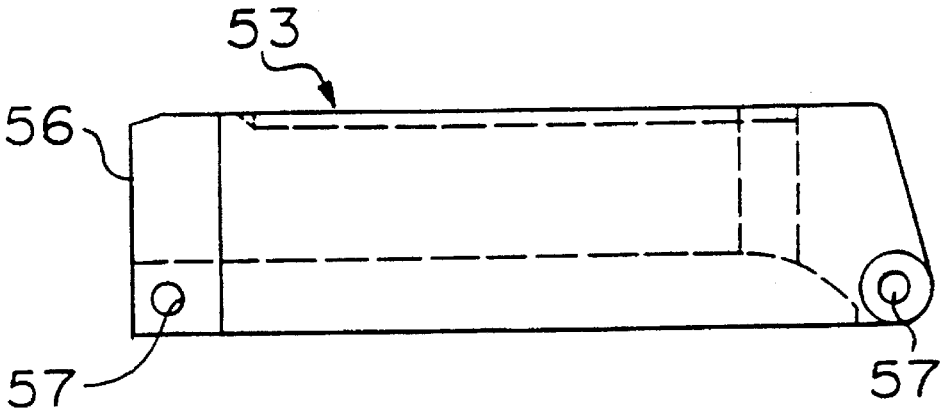
Figure 7:
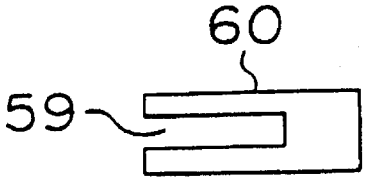
Figure 8:
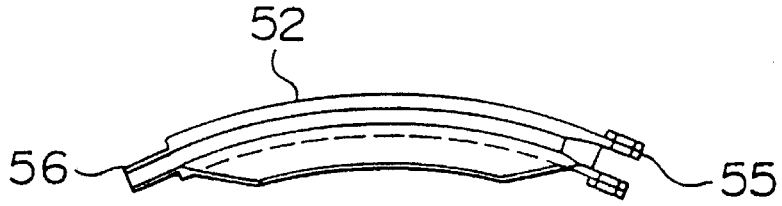
FIGS. 8*a*, 8*b* and 8*c* are respectively a side view, a front view and a cross-sectional view of a corner element for the band guide.
Figure 8:
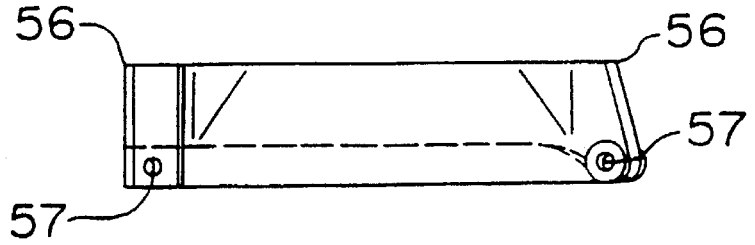
Figure 8:
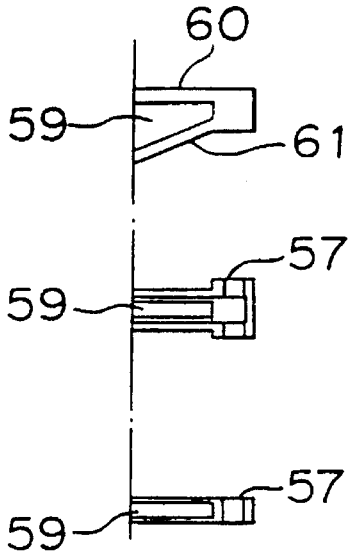

The arch unit 50 has a band guide 51 which is suspended to the arch unit 50 by means of springs 54 so as to have an appropriate swing motion. The band guide 51 is constituted by a plurality of straight elements 53 and a plurality of corner element 52 as shown in FIGS. 6 to 8. Each of the straight elements 53 has a forked portion 55 and an inserting portion 56 so that they have fit-connections with the corresponding portions of adjacent straight elements 53 or corner elements 52. Each of the corner elements 52 has also the same structure. Each of the forked portions 55 and the inserting portions 56 has an opening 57 which is to receive a pivot pin 58 so that the straight elements and/or the corner elements can be connected with an appropriate swing motion.

A guide groove 59 for guiding the band is formed in each of the straight elements 53 and the corner elements 52 which constitute the band guide 51.

FIGS. 7*a* to 7*c* show the shape of the straight element 53 in detail. As is clear from a sectional view of the straight element 53, it has side walls 60 for forming the guide groove 59. The inserting portion 56 or the forked portion 55 of a straight element 53 is fitted to the corresponding portion of an adjacent straight element 53, and a pivot pin 58 is inserted into the opening 57 of the fitted portion of the straight elements 53, whereby they are connected so as to be capable of swinging.

In this embodiment, an inner side wall portion of the corner element 52 is inclined inwardly to the arch unit 50 as indicated by a numeral 61. This structure is useful for easily removing the band from the band guide 51 at a corner portion. However, the shape in cross-section of the corner element may be the same as that of the straight element.

The corner element 52 may be constituted by, for instance, two or three structural elements in order to form a single corner portion of the band guide 51. In this case, each of the structural elements should have the same length. In order to constitute a single corner portion of the band guide by using two structural elements, for instance, each of the elements should cover a part of the corner portion over a range of 45°. When three structural elements are used, each should cover a range of 30°. Accordingly, when a large number of corner elements and straight elements each having the same shape and the same dimensions are prepared, and they are assembled with a suitable combination, a band guide 51 having a desired size which depends on a size of an article to be packed, can be efficiently and freely fabricated.

Figure 9:
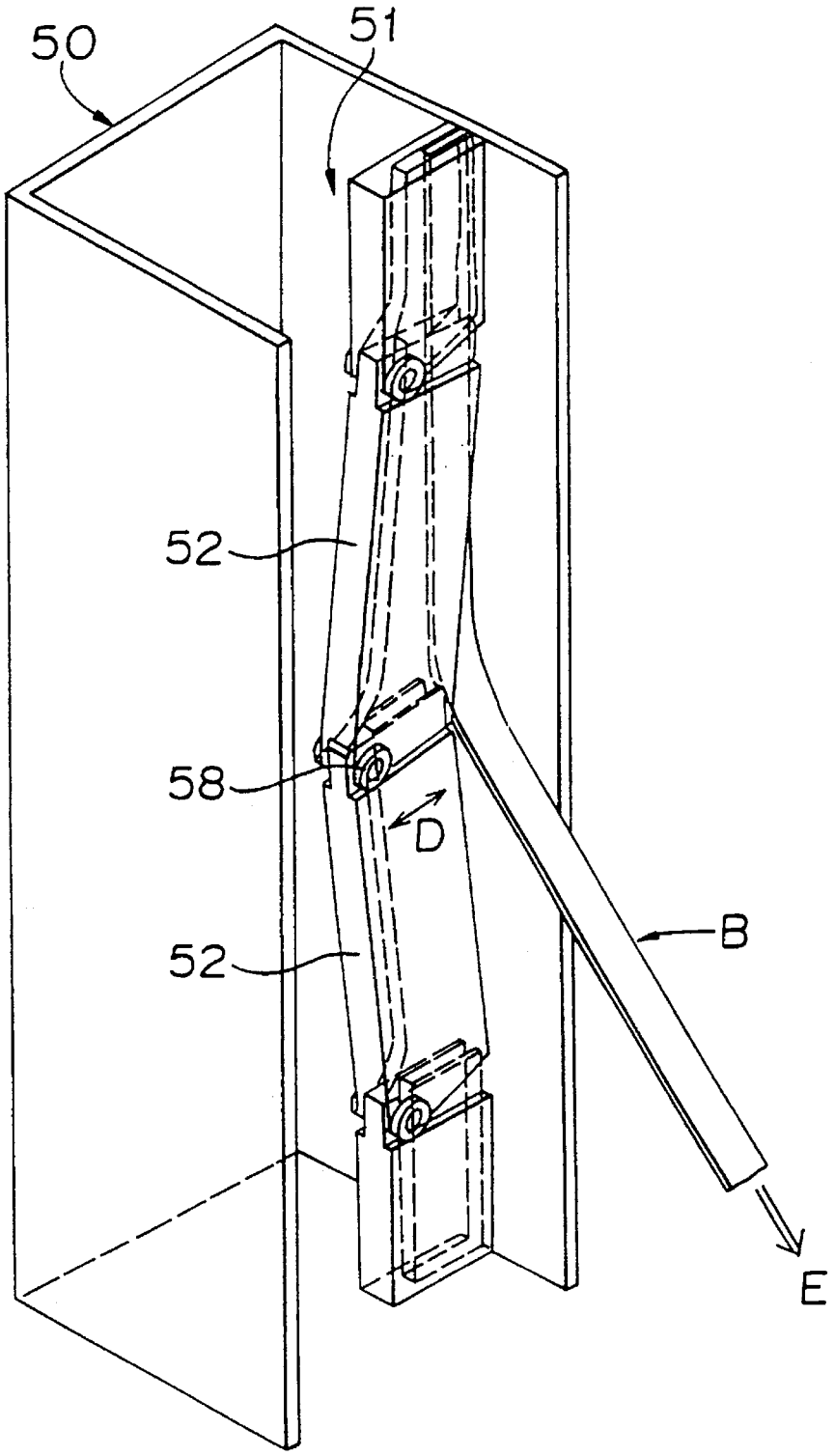
FIG. 9 is a diagram showing a state of a band removed from the band guide.

FIG. 9 shows a behavior of the band guide at the time of returning the band B in a tightening operation in the strapping machine using the band guide 51 according to the present invention. As described before, the band guide is supported by the arch unit 50 by means of the springs 54. Accordingly, when the band is returned, the band guide is moved in a direction D which is substantially perpendicular to a plane on which the straight elements and corner elements of the band guide are laid. In the band guide according to the present invention, only few structural elements just near a position at which the band is removed, is moved whereby the band can be easily removed from the guide groove.

Figure 15:
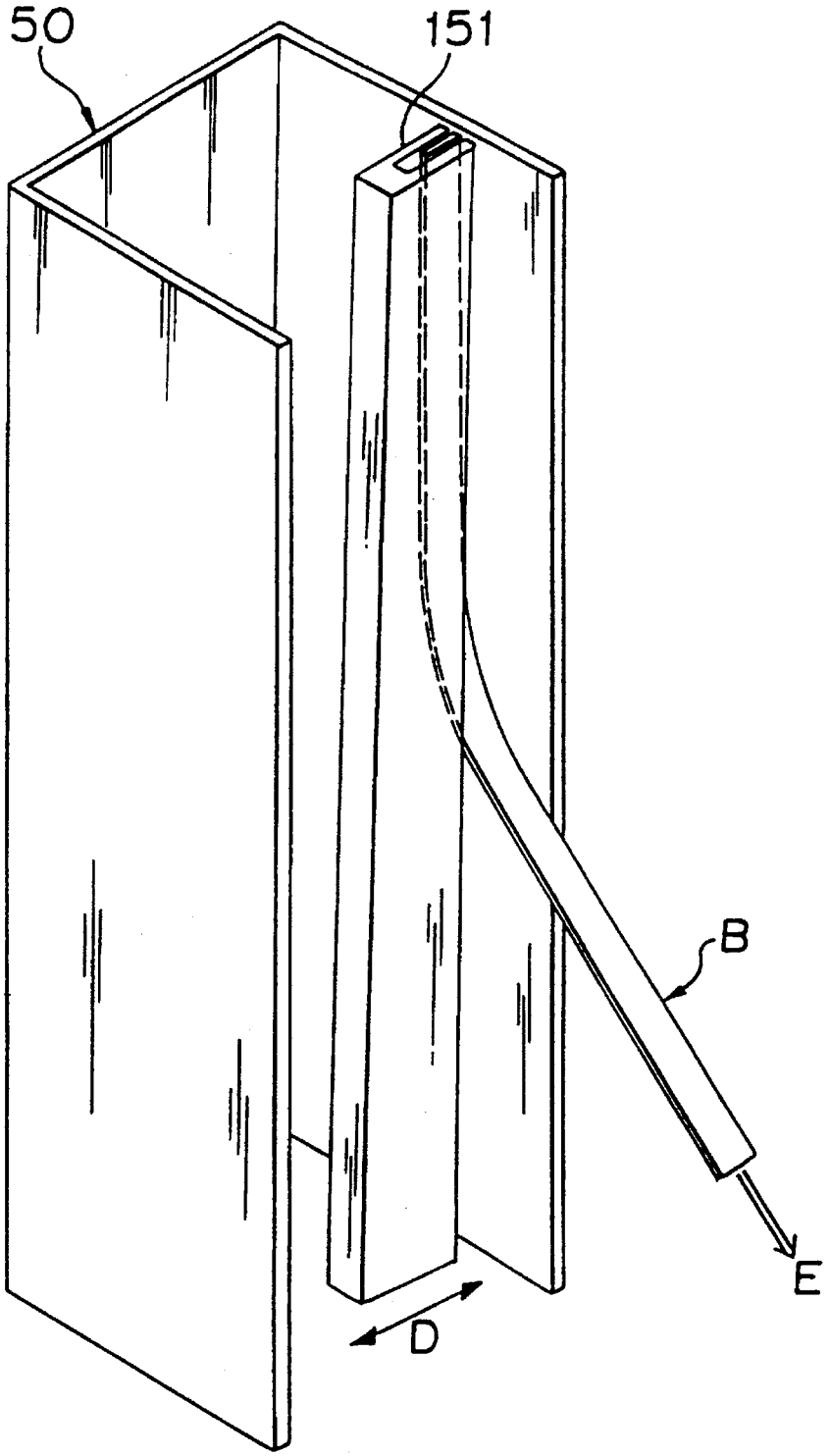
FIGURE 15 PRIOR ART
FIG. 15 is a diagram showing a state of a band removed from the conventional band guide.

On the other hand, in the one-piece body type band guide used for the conventional strapping machine, the band guide 51 moves as a whole with the removal of the band B as shown in FIG. 15. Accordingly, the force of inertia is large and a smooth separation of the band can not be obtained.

The first advantage of the above-mentioned embodiment of the present invention is that a large number of structural elements can be made simultaneously, and manufacturing costs can be fairly reduced since the structural elements for forming any size of arch type band guides are formed of straight elements and corner elements each having the same shape and same dimensions.

The second advantage is that special working processes are not required in assembling, and efficiency of assembling is excellent because any size of arch type band guides can be fabricated by connecting in a suitable combination structural elements having the same shape and same dimensions.

The third advantage is that the band can be smoothly removed from the band guide, and a load to the roller driving unit for returning the band can be reduced since the band guide is formed by connecting a number of structural elements with pivot pins so as to be capable of swinging.

The fourth advantage is that a friction between the band and the wall of the groove of the band guide can be reduced to thereby reduce a load to the roller driving unit when the band is returned.

The fifth advantage is that the band is wound around an article without causing simultaneously falling of band, and accordingly, there is no swinging and twisting of the band since only the structural elements just near a position where the band is removed, are moved.

Another embodiment of the present invention will now be described with reference to FIGS. 10 to 13 wherein an article A having a large width is to be packed. In Figures, the same reference numerals designate the same or corresponding parts.

Figure 10:
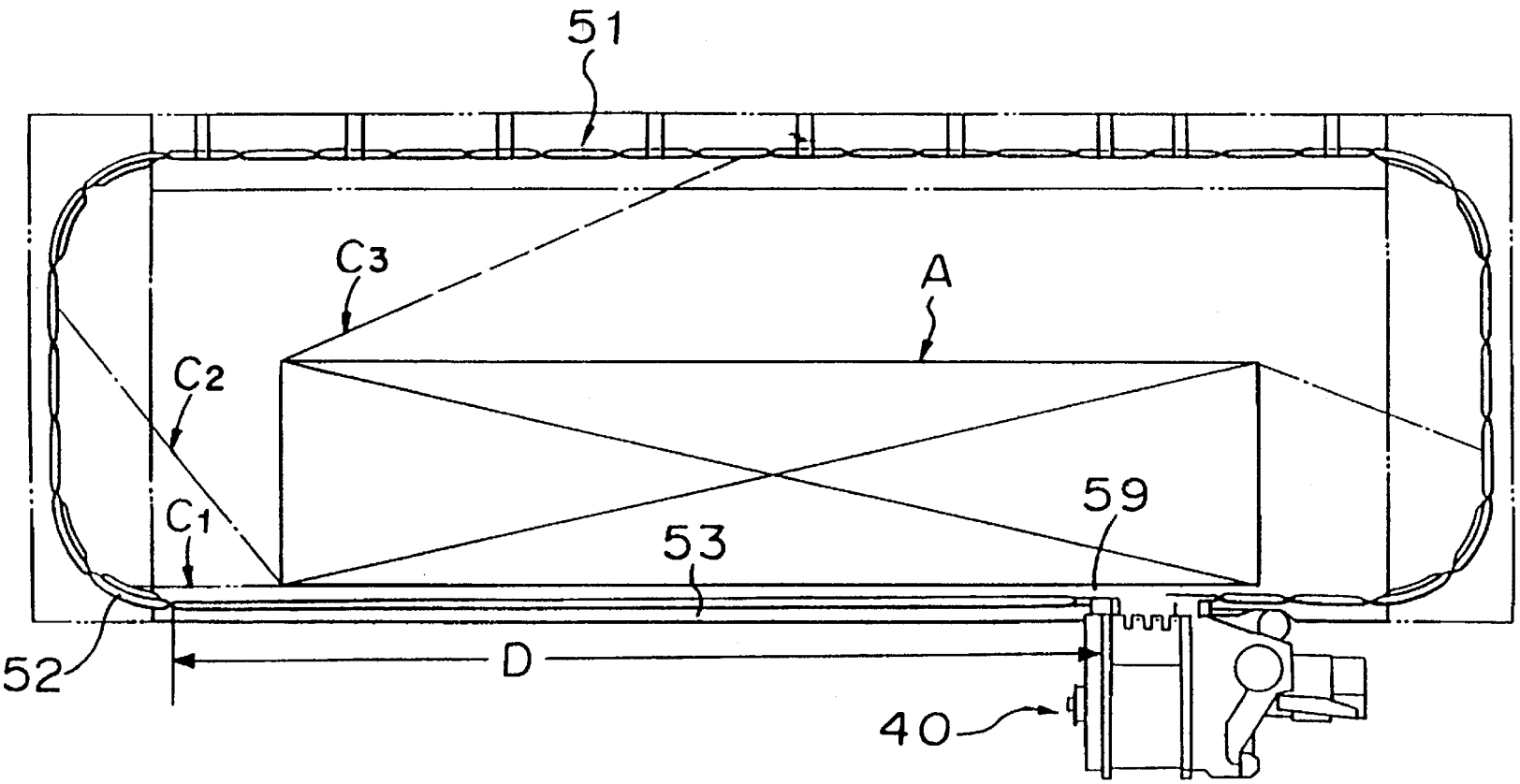
FIG. 10 is a diagram showing another embodiment of the present invention, which shows a state of a band which is separating from an arch unit having a laterally elongated type band guide.

FIG. 10 shows the shape of an arch type band guide suitable for binding an article A having a large width. When the distance D from a band inlet edge 59 of the band guide to a first corner portion 52 of the band guide is elongated in order to bind such article having a large width, the locuses of the band at the time of returning the band with respect to the band guide are indicated by characters C1 to C3. In FIG. 10, the separation of the band starts from a left lower corner portion 52 at which a force of removing the band by a pulling force becomes maximum. Then, the position of separation of the band gradually shifts upwardly. However, since a left lower corner of the article A restricts the band with respect to the vertical position of the band, an increase of force to remove the band at the lower side of the band guide is prevented regardless of the progress of the separation of the band at a left side of the band guide. Accordingly, the shift of the point of separation of the band from the left side to the right side in the lower side portion of the band guide is stopped.

Figure 11:
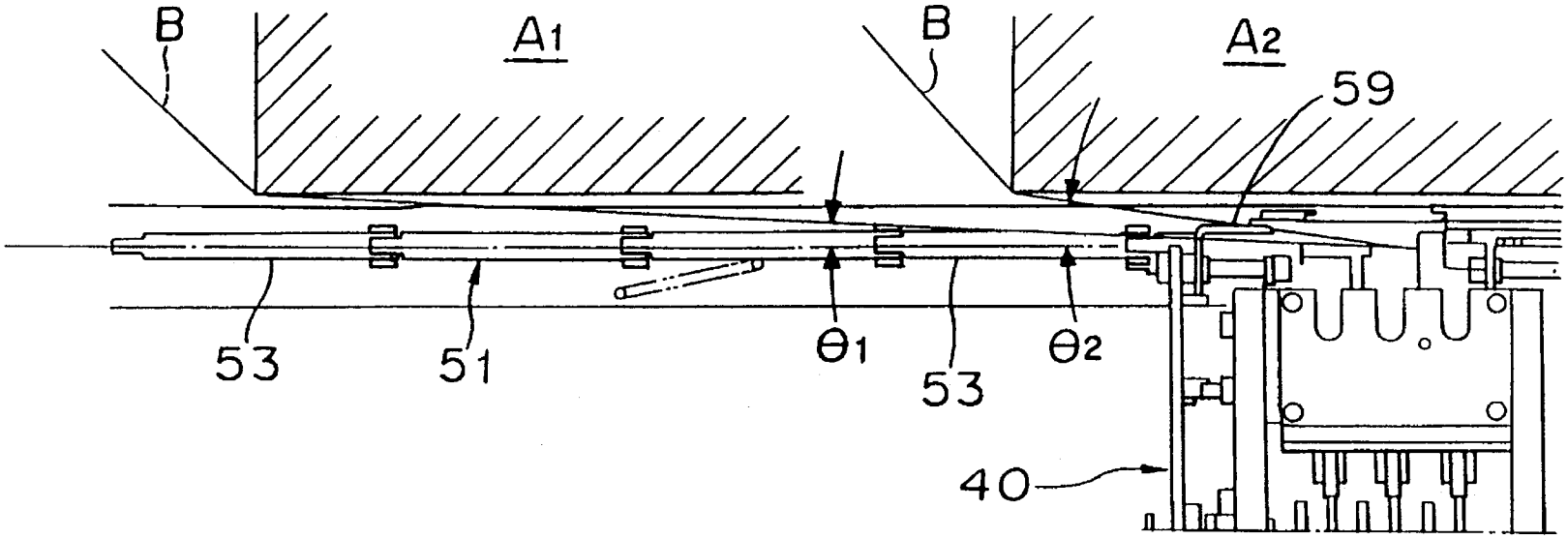
FIG. 11 is a diagram showing the relations of articles having different width to a band wound around the articles.

A more detailed explanation will be provided with reference to FIG. 11. FIG. 11 shows the positional relationship between the band guide and the band B which is removed from the lower side portion of the band guide 51 in a case where articles A1 and A2 having different width are supposed to be tightened with the band. FIG. 11 is to explain a force of the band to be removed from the band guide, the force resulting from a band returning force.

When the article A1 having a larger width is to be bind with use of a band guide having an elongated width, the removal of band starts from a left lower corner portion of the band guide (a force of removing the band from the band guide is the maximum at this portion). The band removed comes to contact with a left lower corner of the article A1. At that moment, the angle formed between the band and the lower side portion of the band guide is θ1. Then, a point of separating the band gradually shifts in the upper right direction of the Figure. On the other hand, another point of separating the band gradually shifts to the band inlet edge at the lower side portion of the band guide.

When the article A2 having a smaller width is to be bound, a point of separating the band which has generated near a left lower corner portion of the article A2 gradually shifts to the upper right direction in the same manner as above, and another point of separating the band shifts to the band inlet edge in a lower side portion of the band guide while the band is restricted with respect to the vertical direction at the left lower corner portion of the article A2. In this case, an angle formed by the band and the band guide 51 is θ2. From the relation of $\theta 1<\theta 2$, when the same band returning force is applied to the band, a force of separating the band in a state of θ1 is smaller than that of θ2.

According, when the article A1 having a larger width is bound, a speed of separation of the band in the lower side portion of the band guide is not sufficient, and it is difficult to return the band at a high speed when the band is returned. Accordingly, there may cause various problems such as a large frictional force between the band and a side wall of the groove of the band guide.

Figure 12:
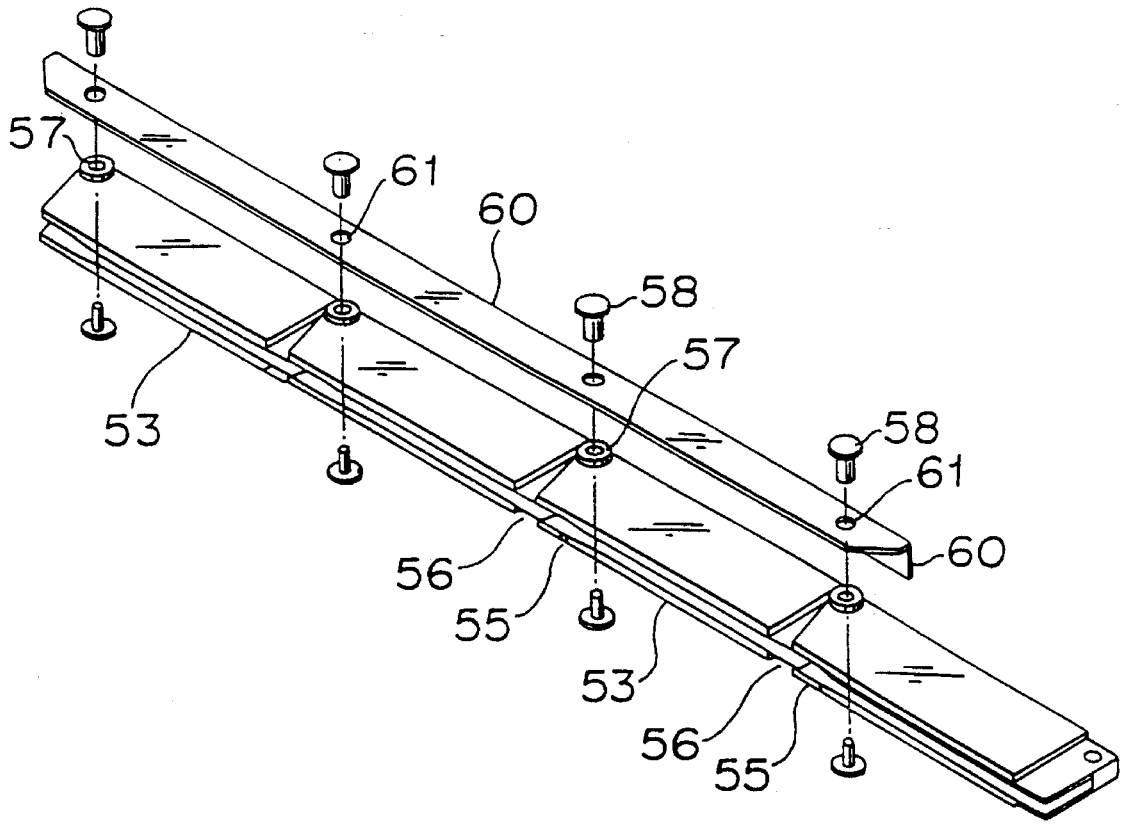
FIG. 12 is an enlarged perspective view showing the relation of the band guide to an angle member for controlling a swing motion of the band guide.

As shown in FIGS. 10 to 12, an angle member 60 is disposed near the band guide to extend from the band inlet edge 59 which is near a sealing anvil to a position near the first corner portion of the band guide so that each of the straight elements is prevented from its swinging motion.

FIG. 12 shows a series of the straight elements 53 which covers the distance from the inlet edge to a position near the first corner portion of the band guide wherein the straight elements are connected by fitting the forked portions 55 to the inserting portions 56 and by engaging connection pins 58 in a manner capable of swinging. In this embodiment, an angle member 60 having the length corresponding to the serial connection of the straight elements 53 is used. The angle member 60 extends along a side and the back side of the straight elements 52 each having a ]-like groove, and the angle member has openings 61 corresponding to the openings 57 formed in the straight elements. The angle member 60 can be connected to the straight elements by inserting connection pins 58 into the openings 57 as well as the openings 61. Thus, the swing movement of the serially connected straight elements 53 is restricted by the angle member 60. Accordingly, a portion of the band guide extending with a desired length from the band inlet edge 59 can be moved as a whole depending on the length of the angle member 60.

Figure 13A:
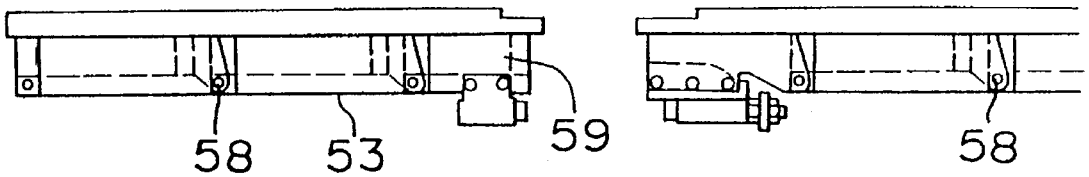
FIGS. 13*a*, 13*b* and 13*c* are respectively diagrams showing the difference in operation of the band guide according to the present invention and a conventional band guide.
Figure 13B:
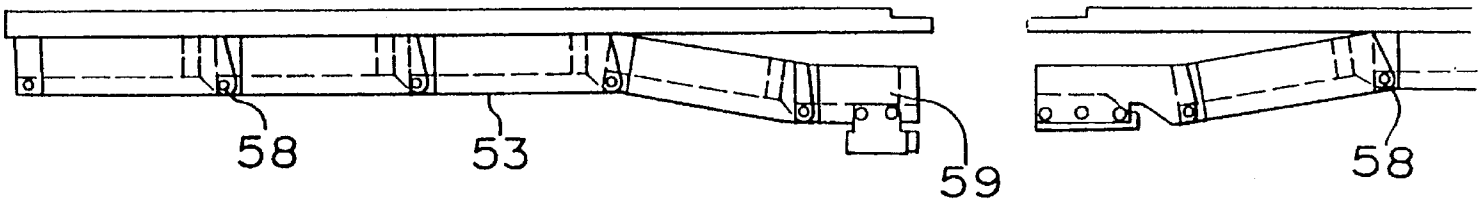
Figure 13C:
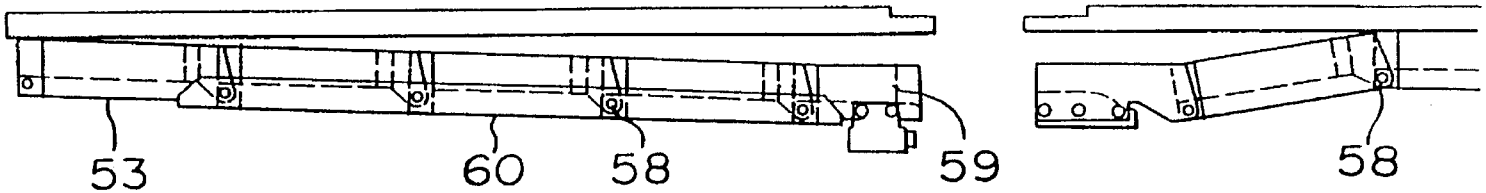
Figure 14:
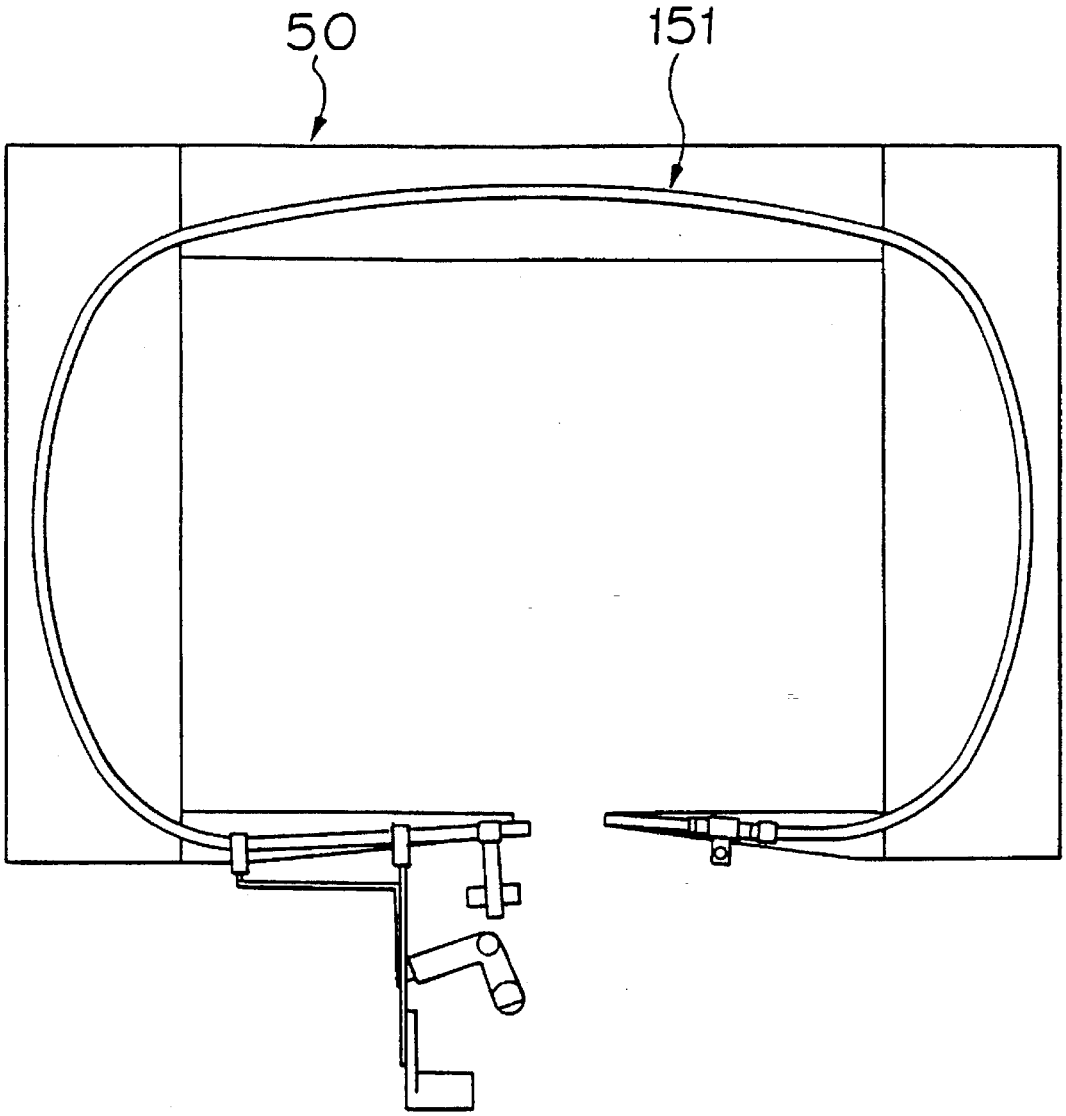
FIGURE 14 PRIOR ART
FIG. 14 is a diagram showing a conventional band guide.

FIG. 13*a* shows a neutral state of a band guide used for binding an article having a smaller width at a position near the inlet edge; FIG. 13*b* shows a movement of a band guide used for binding an article having a larger width at a position near the inlet edge, and FIG. 13*c* shows a movement of the band guide according to the second embodiment of the present invention at the same position.

In FIG. 13*b*, when the band guide is driven horizontally in the direction of separating the band for binding the article having a larger width, an element nearest the inlet edge 59 and straight elements following the element are instantaneously moved. However, other straight elements remain at their original positions. Accordingly, a high speed returning operation is conducted in a state that the band is left in each groove of the straight elements without movement. In the embodiment shown in FIG. 13*c*, however, since the straight elements adjacent to and following to the element disposed at the band inlet edge 59 are restricted from their swinging motion, the straight elements are moved as a whole when the element nearest the inlet edge 59 is driven, whereby the band received in the straight elements in that portion can be instantaneously and easily removed from the groove of the band guide. Accordingly, the friction between the band guide and the band in a high speed returning operation can be eliminated, and highly efficient high-speed tightening is possible. The elements nearest the inlet edge 59 of the band guide is driven in synchronism with the starting of driving the returning roller with use of, for instance, a cam device and a solenoid to accelerate the separation of the band from the band guide.

A description has been made as to the operation for removing band with respect to an article having a larger width. However, it is preferable to move as a whole the straight elements while restricting the swing motion of the elements in order to bind an article having a smaller width also since a force of separation of the band generated at the time of returning the band in the straight elements between the band inlet edge and the first corner portion is small.

According to the second embodiment, the straight elements of the band guide extending from the band inlet edge to the first corner portion, which are used for binding an article having a larger width, are moved simultaneously to quickly remove the band, whereby a friction generated by a high-speed returning of the band can effectively be reduced.

Obviously, numerous modifications and variations of the present invention are possible in light of the above teachings. It is therefore to be understood that within the scope of the appended claims, the invention may be practiced otherwise than as specifically described herein.

I claim:

1. A strapping machine for winding a band around an article and pulling back the band to tighten the band around the article, which machine comprises:

a band guide for guiding the band and having a ]-like shape in cross section, wherein the band guide includes a plurality of straight elements interconnected with a plurality of corner elements, each straight element being integrally formed and each corner element being integrally formed, wherein the straight elements and the corner elements are interconnected in series by pivots so as to be swingable relative to one another, said interconnected straight elements and corner elements forming an arch, said arch lying in a plane within which the straight elements and corner elements are positioned, and wherein said interconnected straight elements and corner elements are swingable relative to one another in a direction substantially perpendicular to said plane.

2. A strapping machine according to claim 1, wherein the straight elements and the corner elements are formed of pieces having the same shape and the same dimensions, respectively.

3. A strapping machine according to claim 1, wherein each of the pivots is formed integrally with each of the elements.

4. A strapping machine according to claim 1, wherein each of the corner elements has an inner wall and an outer wall spaced from the inner wall, and an interconnecting wall interconnecting the inner wall and the outer wall thereby forming the ]-like shape in cross section and wherein the inner wall is inclined such that the spacing between the inner wall and the outer wall increases in a direction moving away from the interconnecting wall when viewing the cross section.

5. A strapping machine according to claim 1, which comprises a mechanism restricting swinging movement of at least some of the straight elements wherein the mechanism restricting swinging movement extends from an end portion of the band guide at which the band is introduced to an area in proximity with a first corner portion of the band guide.

6. A strapping machine according to claim 5, wherein said mechanism restricting swinging movement of the straight elements comprises an angle member extending from the end portion to an area in proximity with the first corner portion and connected to the straight elements in a corresponding area of the angle member.

* * * * *